US006499758B1

(12) United States Patent
Fournier

(10) Patent No.: US 6,499,758 B1
(45) **Date of Patent: *Dec. 31, 2002**

(54) EGONOMIC SPORTSBOARD

(75) Inventor: Louis Fournier, Chicoutimi (CA)

(73) Assignee: William H. Bollman, Bethesda, MD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/044,880

(22) Filed: Mar. 20, 1998

(51) Int. Cl.[7] ..... B63C 5/99
(52) U.S. Cl. ..... 280/609; 280/11.14
(58) Field of Search ..... 280/11.14, 14.2, 280/607, 609, 633, 636; 441/65, 67, 68, 70, 74, 75, 77

(56) References Cited

U.S. PATENT DOCUMENTS

| | | | | | |
|---|---|---|---|---|---|
| 3,332,697 | A | | 7/1967 | Hagen | 280/609 |
| 3,628,804 | A | | 12/1971 | Carreiro | 280/609 |
| 3,689,092 | A | | 9/1972 | Lake | 280/609 |
| 3,900,204 | A | | 8/1975 | Weber | 280/609 |
| 4,305,603 | A | | 12/1981 | Müeller et al. | 280/607 |
| 4,320,905 | A | | 3/1982 | Andrew et al. | 280/609 |
| 4,568,296 | A | | 2/1986 | Newell | 441/70 |
| 4,753,836 | A | * | 6/1988 | Mizell | 428/71 |
| 4,919,447 | A | * | 4/1990 | Jackson et al. | 280/604 |
| 4,974,868 | A | * | 12/1990 | Morris | 280/609 |
| 5,172,924 | A | | 12/1992 | Barci | 280/609 |
| 5,328,200 | A | * | 7/1994 | Pelizzari | 280/609 |
| 5,342,077 | A | * | 8/1994 | Abondance | 280/6 |
| 5,366,234 | A | | 11/1994 | Rohrmoser | 280/610 |
| 5,427,401 | A | * | 6/1995 | Liard | 280/609 |
| 5,529,523 | A | * | 6/1996 | Wilhelmi | 441/74 |
| 5,667,238 | A | * | 9/1997 | Sarver | 280/609 |
| 5,725,236 | A | | 3/1998 | Stephanova et al. | 280/609 |
| 5,766,051 | A | | 6/1998 | Messer | 441/65 |
| 5,816,589 | A | * | 10/1998 | Southworth | 280/14.2 |
| 5,823,562 | A | | 10/1998 | Stubblefield | 580/609 |
| 5,871,223 | A | * | 2/1999 | Zanco | 280/607 |
| 5,871,224 | A | * | 2/1999 | Vance | 280/608 |
| 5,884,934 | A | * | 3/1999 | DeRocco et al. | 280/607 |
| 5,910,035 | A | * | 6/1999 | Rebotier et al. | 441/74 |
| 5,924,718 | A | * | 7/1999 | Gordon et al. | 280/610 |
| 5,984,343 | A | * | 11/1999 | Longoni et al. | 280/602 |

FOREIGN PATENT DOCUMENTS

| | | |
|---|---|---|
| DE | P 36 07 808 A | 9/1987 |
| FR | 2 612 792 | 9/1988 |
| WO | WO 83/00311 | 2/1983 |

* cited by examiner

*Primary Examiner*—Paul N. Dickson
*Assistant Examiner*—L. Lum
(74) *Attorney, Agent, or Firm*—William H. Bollman

(57) ABSTRACT

A sportsboard having an ergonomic upper surface. The upper surface of the sportsboard includes at least one upwardly angled portion with respect to a center of the sportsboard adapted to contact the extremities of a rider, e.g., the feet, boots and/or bindings. Preferably, the angle is between about 1° and 20°, more preferably between about 4° and 14°, and most preferably between 5° and 12°. The angle preferably accounts for an amount of flex in the sportsboard when ridden, and thus may be, e.g., more preferably in a range of between about 4° and 7° in a flexible sportsboard. The extremity contacting sections may be laterally arcuate, may be laterally rotated, and/or may be tilted about a lengthwise axis of the sportsboard. In another aspect, to reduce stiffness in the sportsboard, a plurality of grooves are formed widthwise across the sportsboard, particularly across thicker portions of the sportsboard, to reduce the compression forces necessary to bend the sportsboard in a lengthwise direction.

7 Claims, 16 Drawing Sheets

EGONOMIC SPORTSBOARD

BACKGROUND OF THE INVENTION

1. Field of the Invention

The present invention relates to the field of sporting equipment. More particularly, it relates to a sportsboard used in an upright standing or kneeling position which has an ergonomic upper surface that reduces strain and wear on human joints.

2. Background of Related Art

Various types of sports requiring a sportsboard have become popular. These sports are performed by riding different types of sportsboards on various types of ridden medium, e.g., water, pavement or snow.

For instance, surfboards and wakeboards have become popular sportsboards for use on water. Surfboards are ridden on water by planting a rider's bare feet at two points on the upper surface of the surfboard, with the feet typically placed non-parallel to the length of the surfboard. Wakeboards are towed behind a boat, with a rider kneeling or standing on an upper surface of the wakeboard. Skateboards have become popular sportsboards for use on pavement. Skateboards are ridden by planting a rider's feet (typically wearing sneakers or other street footwear) at two points on the upper surface of the skateboard, the feet being typically placed non-parallel to the length of the skateboard.

Moreover, on snow, snowboards have become particularly popular, by some estimates soon to be more popular than skis. Snowboarding is performed on snow covered slopes which were typically originally designed to accommodate skiers. As is well known, each foot of a skier is mounted with a binding to a respective ski, the feet being mounted parallel to the length of the skis.

Although both skiing and snowboarding are performed on snow, snowboarding differs significantly from skiing in that rather than having separate sportsboards (i.e., skis) for each foot, only a single sportsboard is used. In a typical snowboard mounting configuration, both feet of the snowboarder are fixedly mounted with a binding to the single sportsboard, one in front of the other, and transversely or at an angle to the length of the snowboard. Also, unlike skiing, no poles are used in snowboarding.

There are two prevalent types of snowboard mounting techniques in use today: strap bindings and step-in bindings. Strap bindings allow a user of the snowboard to wear relatively soft boots, which are mounted at a non-parallel angle to the length of the snowboard. The tops of the soft boots and often the upper portions are strapped or clamped onto the snowboard. Step-in bindings are attached to the snowboard at or near the soles of a stiffer boots. Step-in bindings provide added convenience to the user over strap bindings, but come at the cost of less comfortable boots and differing contact pressures between the snowboard and the user's feet.

Use of safety release bindings is usually unnecessary with snowboards, unlike with skis. When a skier falls, each foot has a separate elongated lever attached to it (i.e., a ski) which is capable of applying tremendous torsional force to the skier's ankles or knees. Thus, safety release bindings are a requirement for skis to protect against serious injury to the skier's ankles and knees. On the other hand, since a snowboarder has both feet attached to a single lever or sportsboard (i.e., a snowboard), the twisting force resulting from a fall is exerted on the torso, not necessarily the ankles or knees. The torso of the human body is much more capable of withstanding the forces resulting from a fall without serious injury.

FIG. 20 shows a conventional upright standing position of a user on a sportsboard, e.g., a snowboard.

In particular, in FIG. 20, the left foot 1102 and right foot 1104 of a user are mounted transversely or otherwise at a non-parallel angle to the length of the sportsboard 1100. The user may typically place or mount their left and right feet 1102, 1104 at any position along the upper surface 1110 of the sportsboard. However, if the left and right feet 1102, 1104 are rested or mounted directly below the hips 1112, 1114, poor control of the sportsboard 1100 would result. Conversely, if the left and right feet 1102, 1104 are rested or mounted at too wide a distance apart on the upper surface of the sportsboard 1100, although greater control of the sportsboard 1100 may result, a greater amount of strain may be placed on the human body. For instance, the ankles and knees may be over-strained in maintaining an upright position of the human body, and too large a torque may be required to turn the lager radius formed by the wide distance between the left and right feet 1102, 1104. Thus, a balance is usually made for lateral stability between the amount of control provided by separated placement of the left and right feet 1102, 1104 on the sportsboard, and the strain on the human body, particularly the ankles, knees and torso, based on the feel of the particular rider. Accordingly, a snowboarder is typically forced to assume a wider stance, creating a severe shear effect in the ankle joints of the rider, a loss of aligned momentum to the bindings, asymmetric muscle stress, and generally excessive wear on the joints of the extremity.

Human feet do not generally have strong muscle structure to provide a large amount of lateral strength. To compensate for this, most riders over-use or over-stress the side of the leg muscles, e.g., the tibialis anterior, extensor digitorium longus, peroneus longus, and/or the peroneus previs. For instance, in the now well known talus fracture particularly frequent among snowboarders, some of these muscles as well as the attached ligaments are often damaged.

Although snowboards were largely inspired by water surfboards, the riding characteristics differ greatly, mostly because snowboarders must wear boots while water surfboarders often go barefoot. Thus, the rider of a surfboard has unlimited ankle movement to maintain his or her balance on the surfboard while riding waves, while the ankles of the rider of a snowboard are restricted somewhat by the boots which must be worn, and thus movements of the sportsboard are performed by movement of other elements of the human body. Furthermore, the acceleration and deceleration forces encountered by a snowboarder are typically greater than those encountered by a water surfboarder. Nevertheless, the present invention provides improvements to any type of sportsboard ridden in an upright position, including snowboards and surfboards.

While the popularity of snowboarding and other upright sportsboard type sports has increased sharply over the last few years, various so-called wear-type of injuries have developed. Indeed, the type of stance used by upright users such as snowboarders combined with the types of forces that are exerted during practice of the relevant sport tend to cause accelerated wear on joints such as the hip joints, the knee joints and the ankles of the snowboarder.

As shown in FIG. 20, conventional sportsboard construction includes a relatively flat upper surface 1110 on which the feet 1102, 1104 of the user are rested or mounted during a normal riding stance. It has been discovered by the present inventor that this relatively flat riding surface proves to be a disadvantage in conventional sportsboards.

For instance, when in an upright position on a sportsboard, ground reaction forces are directed upwards against the planter aspect of both feet and maintain the plane equilibrium and stability of the lower extremities and pelvis. With a single sportsboard, equal ground reaction forces are exerted on the lateral and medial planter surfaces of both feet. However, when the trunk is rotated relative to the feet (as is often the case in snowboarding), the reactional forces and the equilibrium are both modified.

For instance, when the trunk is rotated to the right, the right foot supinates and the left foot pronates. The right forefoot inverts from the ground and vertical ground reaction forces are greater against the lateral side of the forefoot and less against the medial side of the forefoot. The left forefoot remains flat on the ground and vertical ground reaction forces are distributed evenly against the forefoot. Conversely, when the trunk is rotated to the left, ground reaction exerts unusual forces against the left forefoot and even forces against the right forefoot.

These type of normal ergonomic reactions of the human body are satisfactory for situations wherein a given individual rests on a static structure. However, when a given individual is subjected to acceleration and deceleration forces, it is recognized by the present inventor that the combination of the reaction forces can lead to accelerated wear on various joints of the human body by using a sportsboard with a relatively flat upper surface. Furthermore, not only is excess wear placed on various joints of the human body, but the control forces generated by the various body parts of the rider to control the sportsboard may not be optimized for the type of movements required, e.g., during riding of a snowboard.

Attempts have been made in the past in the design of, e.g., snowboards, to reduce the wear on various body parts. For example, U.S. Pat. No. 5,172,924 issued to Robert S. Barci on Dec. 22, 1992 (hereinafter "the '924 patent") discloses a snowboard binding system using wedge-shaped base members inserted between the upper surface of the snowboard and the lower surface of the rider's boots. The upper surface of each wedge-shaped base member supports the sole of a boot.

Although the wedge-shaped base member provides a more ergonomic connection between the rider's feet and the sportsboard, the binding system disclosed in the '924 patent has several disadvantages. For example, the wedge-shaped base members separates the rider's feet from the upper surface of the sportsboard and thus adds increased height to the center of gravity of the intended user. The separation of the feet from the upper surface of the sportsboard and the increased center of gravity both degrade control of the sportsboard. Moreover, the physical separation between the soles of the boots and the upper surface of the sportsboard reduces the transmission of some sensorial information from the sportsboard to the feet of the rider when riding on a medium such as snow or water. Furthermore, the wedge-shaped base member creates concentrated areas of stress on the sportsboard that may eventually lead to damage and/or breakage of the sportsboard at or near the point of contact between the wedge-shaped base members and the upper surface of the sportsboard.

Accordingly, there exists a need for an improved sportsboard which reduces wear on a rider, provides accurate control between the rider and the upper surface of the sportsboard, and which provides the necessary sensorial information from the sportsboard to the rider.

SUMMARY OF THE INVENTION

In accordance with the principles of the present invention, an ergonomic sportsboard comprises a lower surface for contacting a medium to be ridden. An upper surface of the ergonomic sportsboard has a first extremity contacting section and a second extremity contacting section. The first extremity contacting section is adapted to receive a first extremity of a rider in a riding position, and the second extremity contacting section is adapted to receive a second extremity of the rider in the riding position. At least one of the first extremity contacting section and the second extremity contacting section form an upward angle of between 1° and 2°.

In another aspect of the present invention particularly relating to a sportsboard for riding on snow, a snowboard comprises a lower surface adapted for contact with snow when the snowboard is ridden. The snowboard also includes an ergonomic upper surface. The ergonomic upper surface includes at least one upwardly angled extremity contacting section corresponding to a generally unstrained extremity of a rider in a riding position.

A method of providing an ergonomic sportsboard in accordance with the principles of the present invention comprises providing a sportsboard with a lower surface adapted for contact with a medium to be ridden. An upper surface is provided on the sportsboard. The upper surface includes at least one upwardly angled extremity contacting section adapted to receive a corresponding extremity of a rider in a riding position. The extremity contacting section forms an angle of between about 1° and 2°.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

A sportsboard in accordance with the present invention has an ergonomic upper surface (e.g., INTRACANT™) which provides several advantages over conventional sportsboards having a relatively flat riding surface.

For instance, an ergonomic upper surface for positioning a rider's feet relative to the sportsboard in a way which reduces the potential for stress or other types of injury to the rider. Moreover, the ergonomic upper surface and positioning of the feet thereon further improves the efficiency of movements by the various body parts of the rider as control forces exerted through the rider's feet to the upper surface of the sportsboard. Furthermore, a sportsboard having an ergonomic upper surface constructed in accordance with the present invention provides increased structural strength and resistance to damage in areas of a sportsboard conventionally subjected to high stress, e.g., directly below the rider's feet. Moreover, the ergonomic upper surface in accordance with the principles of the present invention allows a rider to maintain an improved center of balance with respect to the sportsboard.

Figure 1:
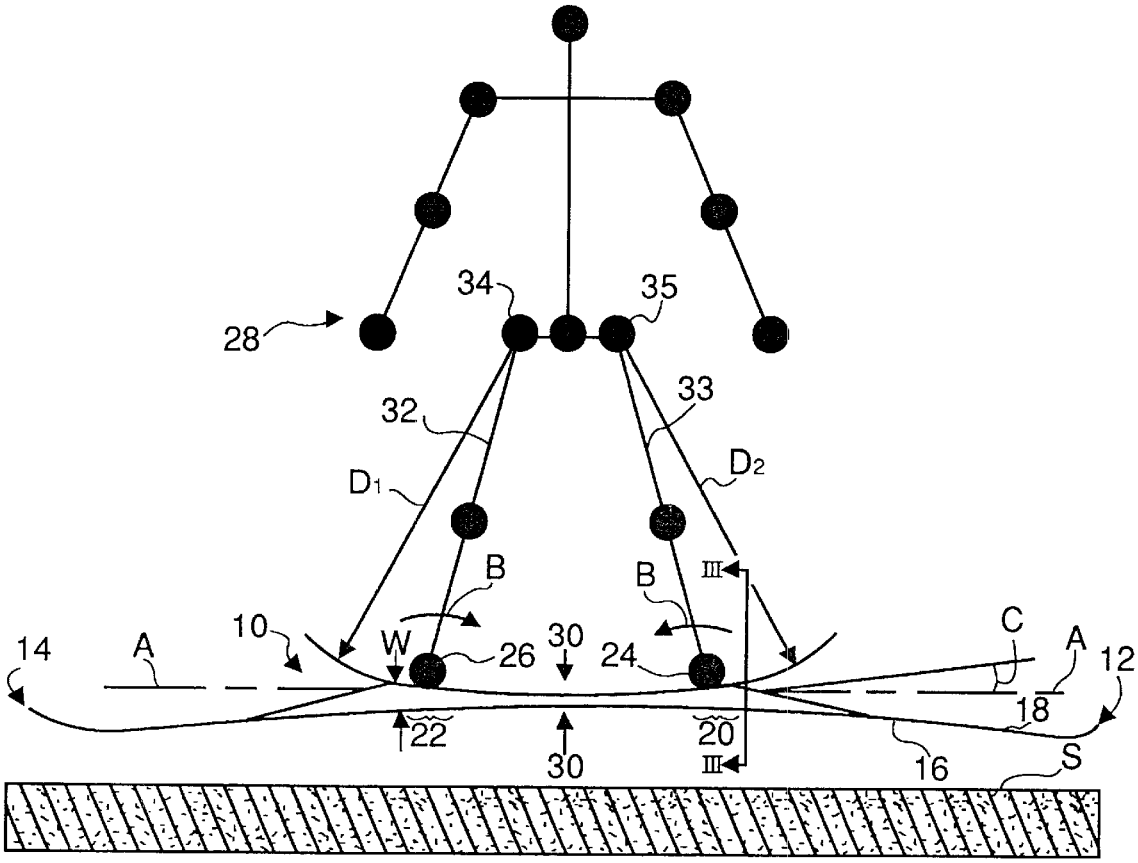
FIG. 1 is a schematic elevation view of a snowboard in accordance with the first embodiment of the present invention, the snowboard being shown with a rider mounted thereon.

FIG. 1 shows a sportsboard 10 having an ergonomic upper surface 18 in accordance with a first embodiment of the present invention.

In FIG. 1, a sportsboard 10 has a generally elongated configuration. The sportsboard 10 may be a snowboard, a wakeboard, a surfboard, a sailboard, a skateboard, etc. The present invention provides significant advantages for all types of sportsboards, particularly for snowboards and for sailboards wherein a significant amount of downward pressure is placed on the contacting extremities, e.g., the feet, even in excess of the weight of the rider.

The sportsboard 10 has a first end section 12 and a longitudinally opposed second end section 14. An under or lower surface 16 of the sportsboard 10 defines a medium contacting surface which is generally in contact with a medium S (e.g., snow or water) when the sportsboard 10 is ridden, and the ergonomic upper surface 18 forms an efficient interface between the rider's feet and the sportsboard 10.

Importantly, the present invention provides a curved, ergonomic upper surface 18 in a portion of the sportsboard 10 wherein the rider's feet are rested or mounted. A pair of longitudinally spaced apart extremity contacting sections 20 and 22 are configured, positioned and sized so as to respectively receive a first extremity (e.g., foot) 24, and a second extremity (e.g., foot) 26 of a rider 28. The extremity contacting sections 20 and 22 are angled upwardly with respect to a center of the sportsboard 10 such that the extremities (e.g., feet) 24 and 26 pivot inwardly toward the center of the sportsboard 10, as indicated by arrows B in FIG. 1.

It should be understood that although the extremity contacting sections 20 and 22 illustrated in FIG. 1 are angled substantially symmetrical relative to one another, only one extremity contacting section need be angled. Alternatively, the extremity contacting sections 20 and 22 may be angled unsymmetrical relative to one another without departing from the scope of the present invention.

Furthermore, the spacing between the extremity contacting sections 20 and 22 may be any suitable distance. For instance, the extremity contacting sections 20 and 22 may be two ends of a single continuous extremity receiving section, and thus the spacing would be zero. Alternatively, the spacing may be large with respect to a typical stance by the rider, e.g., larger than that relatively shown in FIG. 1, without departing from the scope of the present invention. Similarly, the distance between the first end section 14 and the first extremity contacting section 22, and the distance between the second end section 12 and the second extremity contacting section 20, may be any suitable distance other than that relatively shown in FIG. 1, without departing from the scope of the present invention.

The upper surface of the upwardly angled extremity contacting sections 20 and 22 can be relatively flat or upwardly arcuate. An angle C is formed between the upwardly angled extremity contacting sections 20 and/or 22 at a contact point with the extremity, and a theoretical horizontal plane A including the contact points at each extremity contacting section 20 and/or 22. The theoretical horizontal plane A is referred to herein as a 'major horizontal plane'. A relatively flat upwardly angled extremity contacting section 20, 22 will have a relatively constant angle C throughout its area, whereas an upwardly arcuate contacting section 20, 22 will have a range in the value of the angle C depending upon the point of contact between the extremity and the extremity contacting section 20, 22.

The preformed, unflexed angle C is preferably in a range between 1° and 20° with respect to the point of contact of the extremity and the theoretical horizontal plane A, more preferably in a range between 4° and 14°, and most preferably in a range between 5° and 12 °.

For flexible sportsboards such as snowboards, the angle C should also take into account an amount of flex in the sportsboard 10. For instance, snowboards are determined to normally flex or deform about 5° to 7° with respect to the point of contact of the extremities. Thus, the angle C for such a sportsboard is preferably in a range between 4° and 7°, which, together with the added angle due to the flex when the sportsboard is ridden, will provide a total angle of between 9° and 14°.

For sportsboards which do not deform significantly when ridden, e.g., surfboards, wakeboards and sailboards, the preformed, unflexed angle C is preferably at least 4°, more preferably at least 5°, and most preferably at least 6°.

Figure 3:
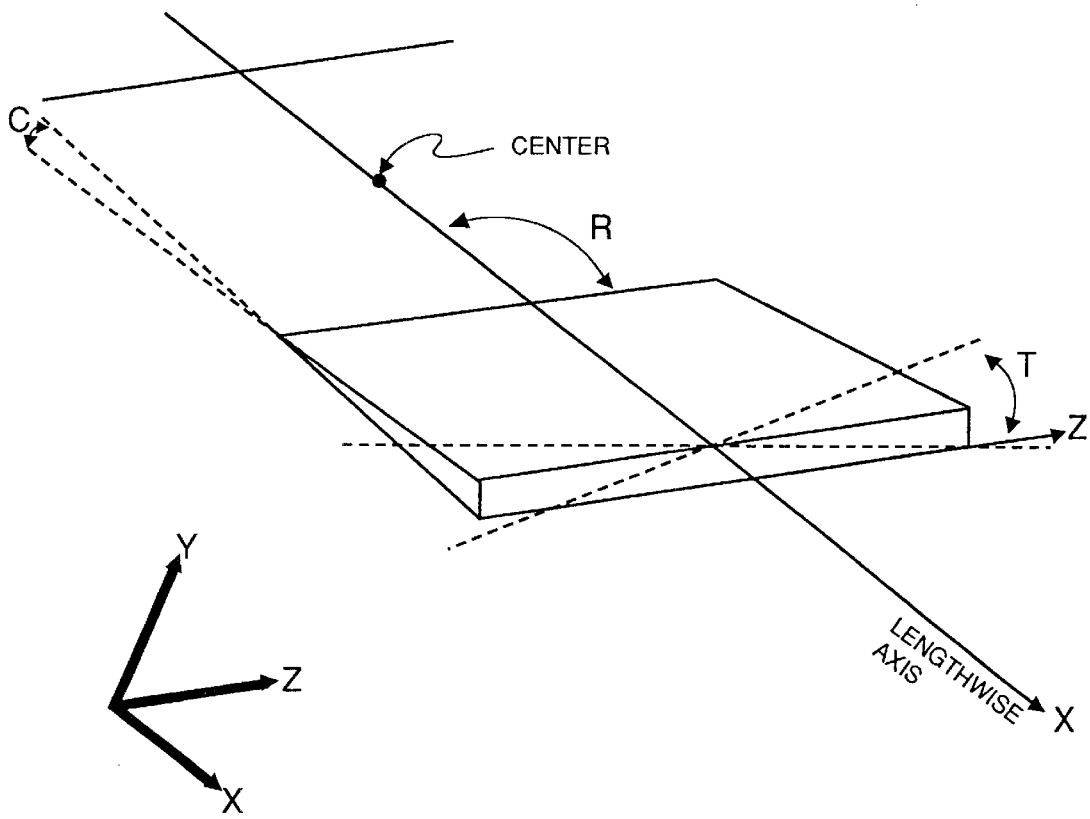
FIG. 3 shows the positioning of an upwardly angled extremity contacting section with respect to an x-y-z plane.

In addition, the upwardly angled extremity contacting sections 20 and/or 22 may be additionally laterally rotated an angle R about the center of the sportsboard 10, i.e., about the y-axis as shown in FIG. 3, to optimize the ergonomic benefits to contact with an extremity at an angle other than perpendicular to the lengthwise axis of the sportsboard 10. The angle R may be any appropriate value from 0° to 180° with respect to the lengthwise x-axis of the sportsboard 10 as shown in FIG. 3.

Furthermore, the upwardly angled extremity contacting sections 20, 22 may be tilted an angle T about the lengthwise x-axis as shown in FIG. 3, to accommodate a more comfortable position of the sportsboard 10 with respect to the extremities of the rider. It is preferred that the tilt angle T be within about +/−5° with respect to the x-z plane as shown in FIG. 3.

Moreover, as shown in FIG. 1, at the upper ends of the extremity contacting sections 20 and 22, the sportsboard 10 has a thickest cross-sectional width W between the lower surface 16 and the upper surface 18 of the sportsboard 10.

A first radius of curvature $D_1$ may be defined between an intermediate or center section 30 of the ergonomic upper surface 18 of the sportsboard 10 and the upper end of the first extremity contacting section 22, and a second radius of curvature $D_2$ may be defined between the center section 30 of the ergonomic upper surface 18 of the sportsboard 10 and the upper end of the second extremity contacting section 20. The first radius of curvature $D_1$ is defined by a lateral movement of the first leg 32 of the rider 28 about its corresponding hip 34. Similarly, the second radius of curvature $D_2$ is defined by a lateral movement of the second leg 33 of the rider 28 about the other hip 35. So long as both legs 33, 34 of the rider 28 are the same length, the first and second radius' of curvature $D_1$ and $D_2$ will be substantially equal, and collectively referred to herein as "the radius of curvature D". The larger the radius of curvature D, the generally wider apart will be the range of the extremity contacting sections 20 and 22.

The radius of curvature D can be customized for specific hip configurations. For instance, the ergonomic upper surface 18 may have a relatively small radius of curvature D for shorter riders, while the ergonomic upper surface 18 may have a relatively large radius of curvature D for taller riders. Thus, e.g., an entire line of snowboards may be manufactured each having a particular radius of curvature corresponding to a typical stance of a person of a particular height. Similarly, a line of sportsboards such as snowboards can be focused on the typical height of women, and a separate line of similar sportsboards can be focused on the typical height of men.

Figure 2:
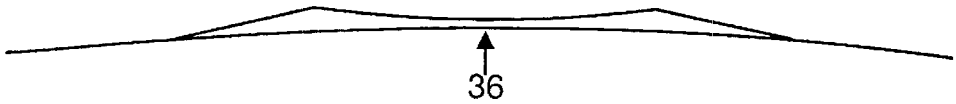
FIG. 2 is an elevation view illustrating an insert component part of the snowboard shown in FIG. 1.
Figure 4:
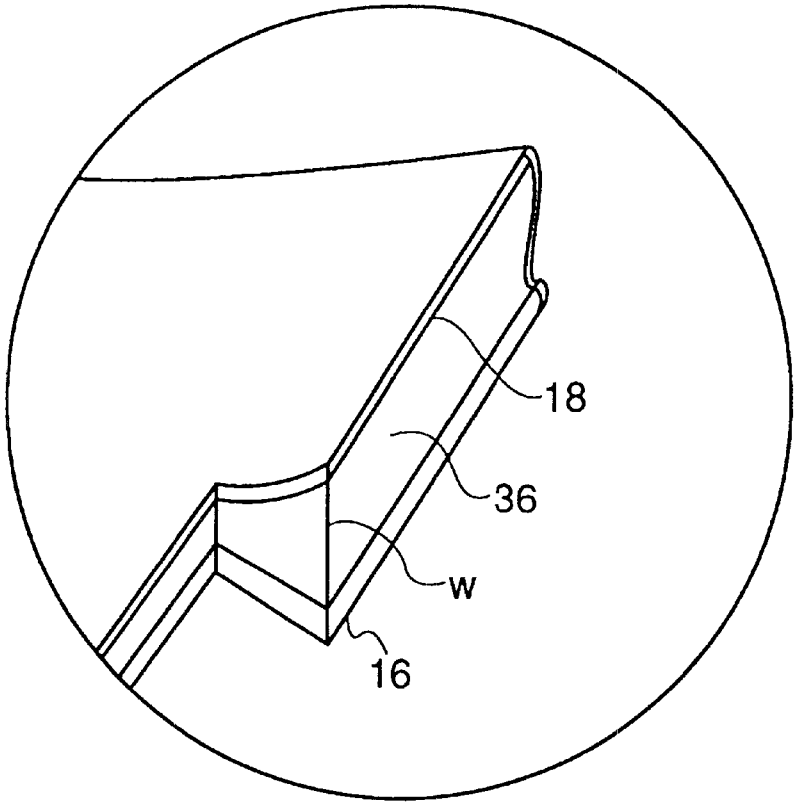
FIG. 4 is a perspective view illustrating a section of the snowboard illustrated in FIG. 1, taken along section III—III of FIG. 1.

In the embodiment illustrated in FIGS. 1–3, the body of the sportsboard 10 is provided with a singular core 36 illustrated more specifically in FIG. 2. The core 36 typically extends integrally from the first end section 14 to the second end section 12. FIG. 4 shows the increased width W of the core 36 of the sportsboard 10, particularly at the outer portions of the extremity contacting sections 20, 22.

As discussed, some prior art devices position a separate wedge-shaped block between the rider's extremity and a localized area of the upper surface of a relatively flat conventional sportsboard. However, wedge-shaped blocks can cause localized stress in the sportsboard, particularly at a point of contact between the wedge-shaped block and the upper surface of the sportsboard.

The sportsboard 10 in accordance with the principles of the present invention includes structure to angle the extremity contacting sections 20, 22 (i.e., core 36). The structure either includes the ergonomic upper surface 18, and/or is positioned between the ergonomic upper surface 18 and the medium-contacting lower surface 16. Thus, as compared with conventional ergonomic solutions to the upper surface of a sportsboard, the core 36 of a sportsboard 10 in accordance with the present invention is in more direct contact with the rider's feet, via the upper surface 18, than with prior art sportsboards.

Figure 5:
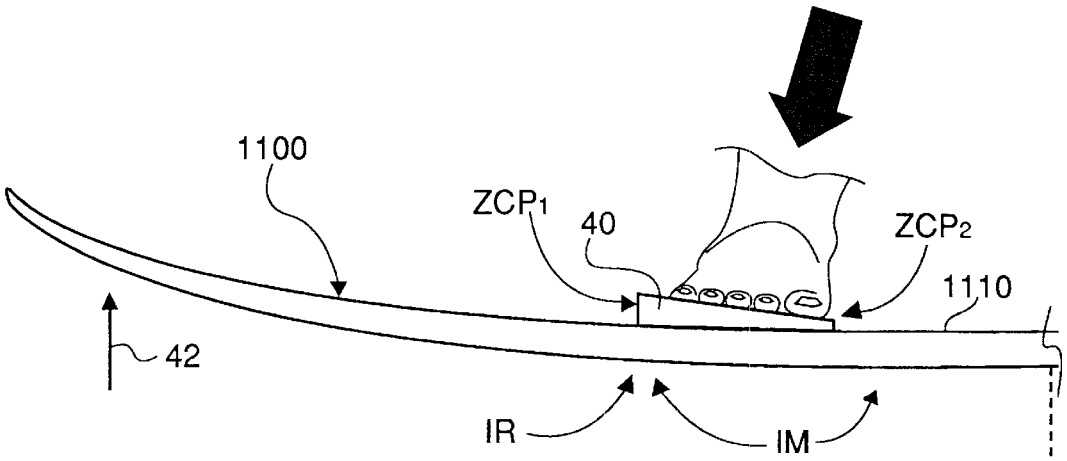
FIG. 5 (PRIOR ART)
FIG. 5 is an elevation view with sections taken out, illustrating a section of a conventional sportsboard, as it is subjected to a bending stress.
Figure 6:
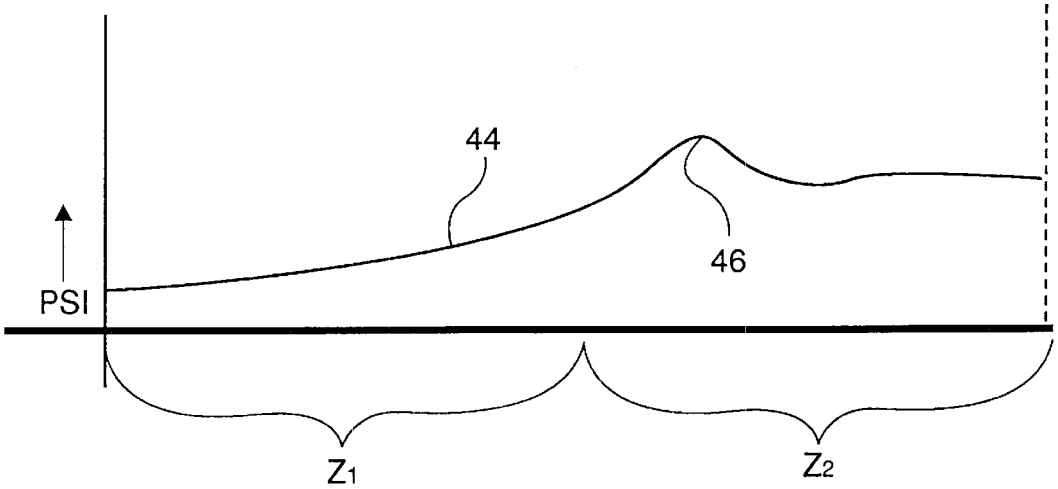
FIG. 6 (PRIOR ART)
FIG. 6 is a schematic view illustrating a curve representing the internal stress generated inside the sportsboard illustrated in FIG. 5.
Figure 7:
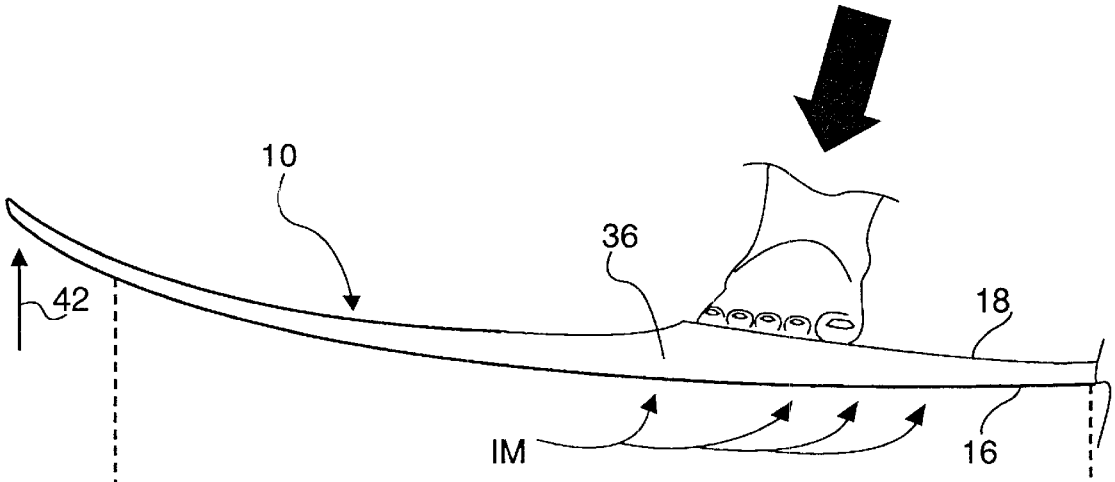
FIG. 7 is an elevation view with sections taken out, illustrating a snowboard in accordance with an embodiment of the present Invention, as it is subjected to a bending stress.
Figure 20:
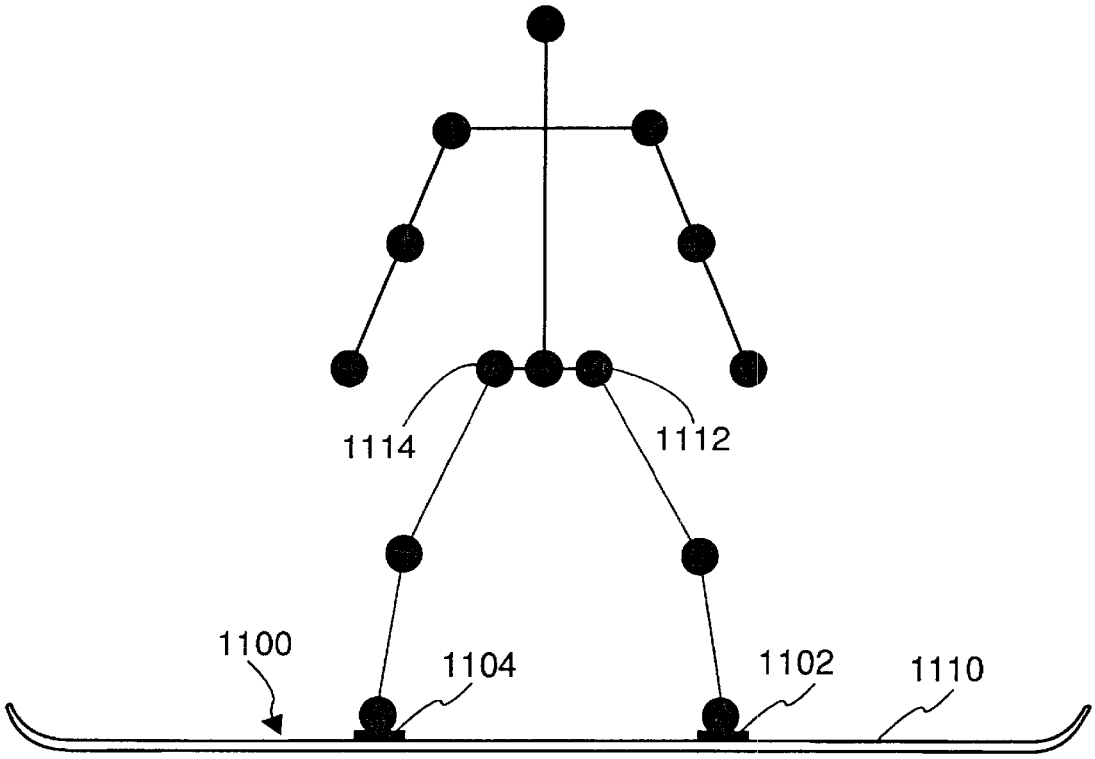
FIG. 20 (PRIOR ART)
FIG. 20 is a schematic view of an upright standing rider mounted to a conventional sportsboard having a relatively flat upper surface.

FIGS. 4 to 7 illustrate more clearly the advantages of the angled extremity contacting sections 20, 22 of the ergonomic upper surface 18 of a sportsboard in accordance with the present invention. FIGS. 4 and 5 show the conventional sportsboard 1100 shown in FIG. 20, but further including a wedge-shaped block 40 mounted on a relatively flat extremity contacting section, and while subjected to a bending stress. FIGS. 6 and 7 show a sportsboard 10 having angled extremity contacting sections in accordance with the principles of the present invention, while subjected to a similar bending stress.

In particular, FIG. 5 shows a conventional sportsboard 1100 with a conventional wedge-shaped or angled block 40 mounted on an extremity contacting section of a relatively flat upper surface 1110 thereof. Although the extremity (in this case a foot of the rider) is shown barefoot, it is to be understood that the invention is equally applicable to a sportsboard accepting a boot or other apparatus morn on the foot or other extremity of the rider. The foot is shown barefoot merely for clarity of explanation.

FIG. 6 illustrates a strain curve 44 corresponding to the bending stress 42 (FIG. 5) applied to one end of the sportsboard 1100. The relative strain caused in the length of the conventional sportsboard 1100 is shown, in pounds per square inch (PSI). A local peak or significantly excessive amount of strain 46 is caused in the conventional sportsboard 1100 at a portion corresponding to an extremity contacting section having a wedge-shaped block 40 in contact therewith.

The significantly excessive amount of stress, particularly at the local peak 46, causes decreased control of the sportsboard 1100, decreased response of the sportsboard, and increased possibility of the structure of the sportsboard 1100 failing in the area corresponding to the peak stress 46, i.e., below the wedge-shaped block 40.

Conversely, FIGS. 6 and 7 illustrate a bending stress indicated by the arrow 42 similar to that shown with respect to the conventional sportsboard 1100 shown in FIGS. 4 and 5, but as applied to a sportsboard 10 having angled extremity contacting sections and ergonomic upper surface 18 in accordance with the principles of the present invention.

In particular, FIG. 7 shows a sportsboard 10 including a core 36 defining at least one angled extremity contacting section at the point of contact of the rider's foot on the ergonomic upper surface 18 of the sportsboard 10.

Figure 8:
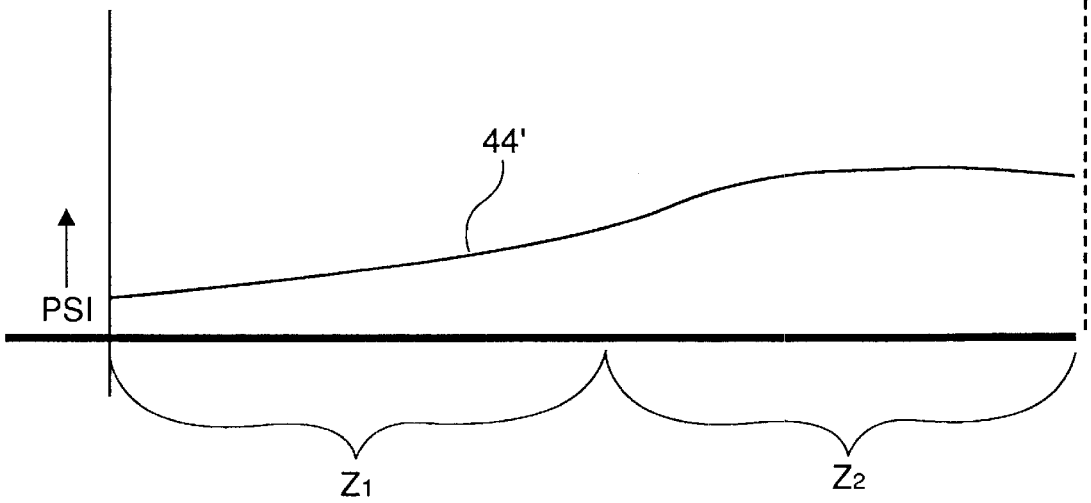
FIG. 8 is a schematic view illustrating a curve corresponding to the internal stress generated inside the board illustrated in FIG. 7.

FIG. 8 shows a strain curve 44' corresponding to the bending stress applied along the length of the sportsboard 10 during application of the same bending stress 42 shown in FIG. 7. The strain curve 44' defines a relatively smooth distribution of the stress along the length of the sportsboard 10. Note that the present invention reduces or eliminates the peak or significantly excessive stress in the extremity contacting portion of the sportsboard 10.

The conventional wedge-shaped blocks 40 are not embedded within the body of the sportsboard 10, e.g., under the upper surface 18, and thus control forces are not transmitted directly from the rider, via the wedge-shaped block 40, to the sportsboard 10. Hence. reaction time of the sportsboard 10 after control forces are initiated by the rider, and the predictability of the sportsboard 10, suffers. In accordance with the principles of the present invention, the geometry of the internal and/or upper structure of the sportsboard 10, particularly in the region(s) corresponding to the extremity contacting section(s), is determined by a structural component positioned within the board, as opposed to a structure mounted on top of a relatively flat upper surface as in conventional sportsboards. The resulting smooth distribution of the bending stress provides a sportsboard 10 with better control, better response, and better reliability as compared with conventional sportsboards, e.g., having a wedge-shaped block 40.

Moreover, wedge-shaped blocks 40 increase the distance between the sole of the extremity, e.g., foot, and the upper surface of the sportsboard, thus raising the center of gravity of the rider with respect to the sportsboard. Most riders find this disadvantageous because it reduces response of the sportsboard and the level of control which the rider has over the sportsboard. In accordance with the principles of the present invention, the angling of the core 36 and/or upper surface 18 of the sportsboard 10 allows for more direct contact between the rider's extremities (e.g., feet) and the core 36 of the sportsboard 10. Thus, the center of gravity of the rider is generally lowered, allowing better control and response of the sportsboard 10.

The extremity contacting sections 20 and 22 may be angled above the main level of the upper surface 18, or they may be countersunk with respect to the other portions of the upper surface 18 of the sportsboard 10. Countersunk extremity contacting sections 20 and 22 can lower the center of gravity of the rider with respect to the sportsboard 10.

Figure 9:
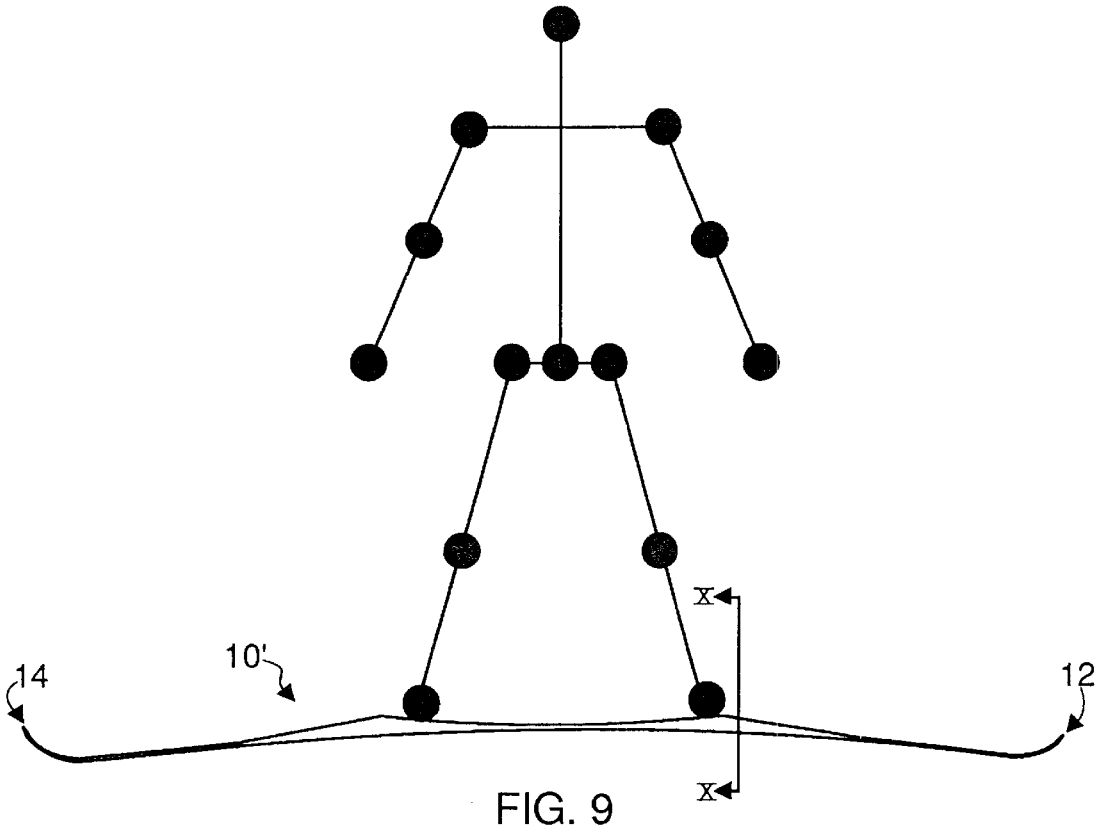
FIG. 9 is a schematic elevation view illustrating a snowboard in accordance with a second embodiment of the present invention.
Figure 10:
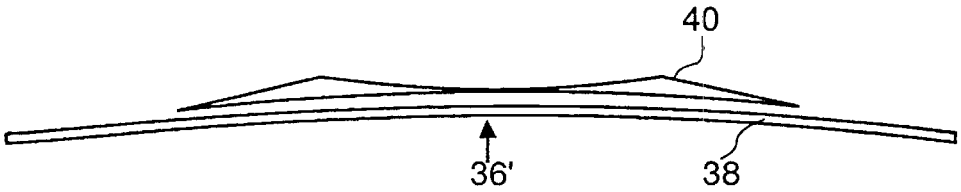
FIG. 10 is an elevation view illustrating an insert component part of the snowboard illustrated in FIG. 9.
Figure 11:
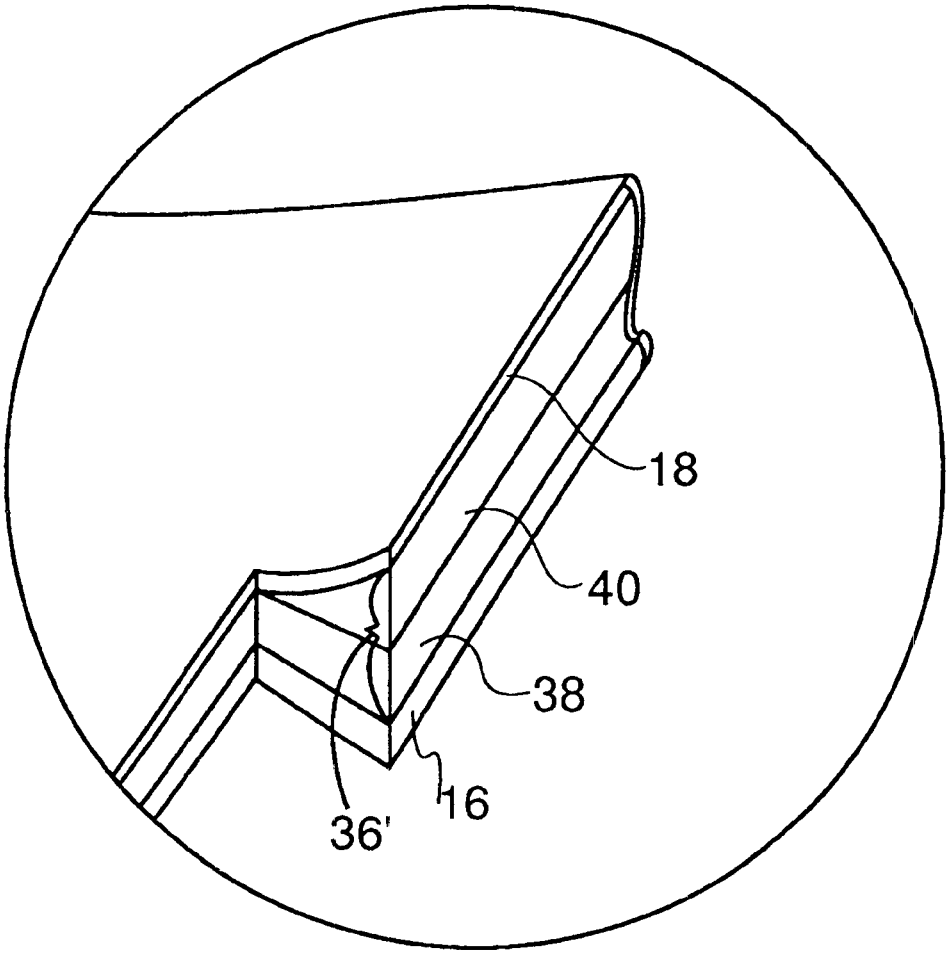
FIG. 11 is a perspective view with sections taken out, illustrating a section of the snowboard illustrated in FIG. 9, taken along section X—X of FIG. 9.

FIGS. 8 to 10 illustrate another embodiment of a sportsboard in accordance with the principles of the present invention.

The sportsboard 10' shown in FIGS. 8 to 10 is substantially the same as the sportsboard 10 illustrated in FIGS. 1–3, with the exception of the core. In FIGS. 1 to 3, the core 36 was of a generally singular construction. However, the core 36' of the sportsboard 10' shown in FIGS. 8 to 10 is a laminate composite.

The laminate composite core 36' includes a conventional core component 38 extending substantially from the first end section 14 to the second end section 12, and an insert core component 40 extending substantially between both extremity contacting sections 20 and 22. Of course, more than two core layers may be implemented to form a core structure forming at least one upwardly angled extremity contacting section, in accordance with the principles of the present invention.

Figure 12:
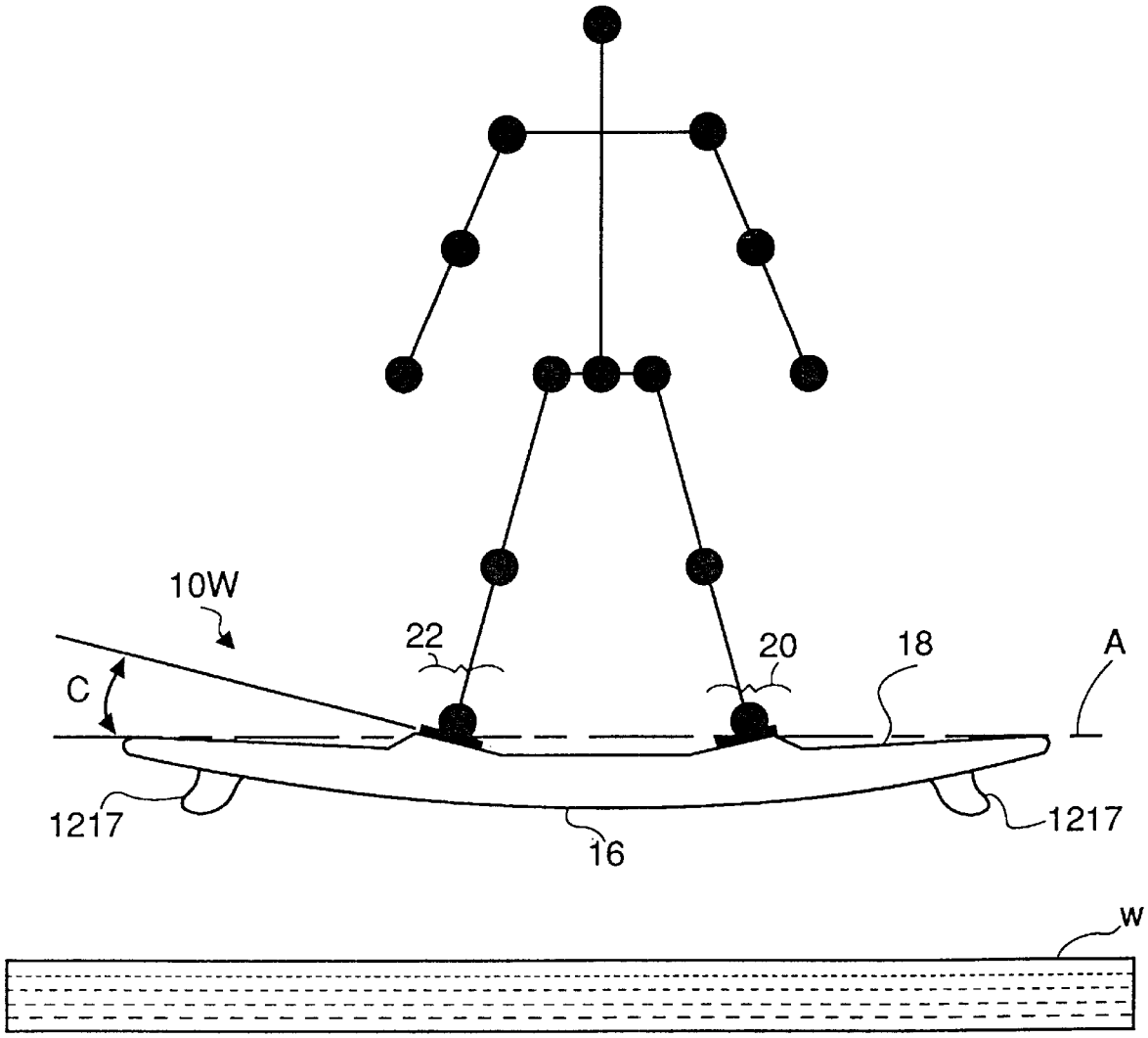
FIG. 12 shows a wakeboard in accordance with the principles of the present invention.

FIG. 12 shows a wakeboard **10*w*** ridden on a medium W such as water, in accordance with the principles of the present invention.

In particular, the wakeboard **10*w* includes two extremity contacting sections 20, 22 in an upper surface 18 thereof. The positioning of the upwardly angling extremity contacting sections 20, 22 are as described with respect to the embodiment shown in FIGS. 1 to 4**, including the angles C, R and T.

Note that the wakeboard **10*w* typically has one or more fins 1217 and an upwardly curving lower surface 16 from the perspective of the rider. Nevertheless, the angling of the extremity contacting sections 20, 22, particularly the upward angle C, is unaffected by the curvature of the lower surface 16**.

Since the extremity contacting portions 20, 22 of the sportsboard 10 present a greater thickness as they angle upwardly, the extremity contacting portions 20, 22 increase the torsional rigidity of the sportsboard 10 at respective locations where torsional rigidity is most suitable. However, if increased torsional rigidity is not desired, flexibility can be added to the sportsboard 10, particularly but not exclusively in the extremity contacting portions 20, 22.

Figure 13A:
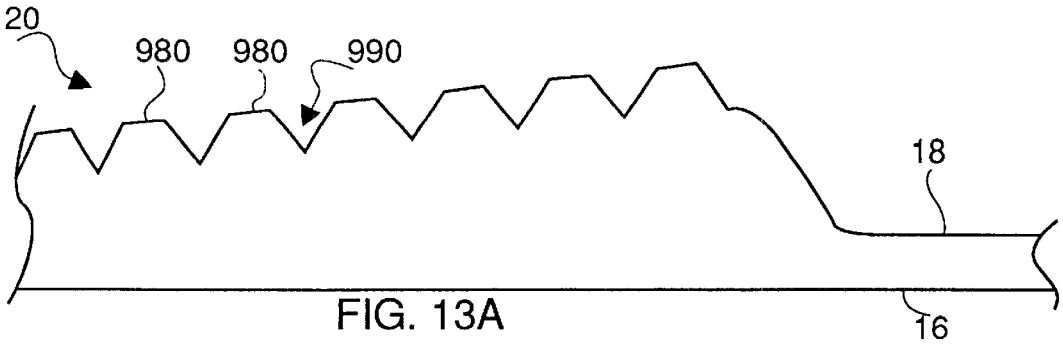
FIGS. 13A to 13C show three embodiments of added flexibility in the upper surface of a sportsboard in accordance with an aspect of the present invention.
Figure 13B:
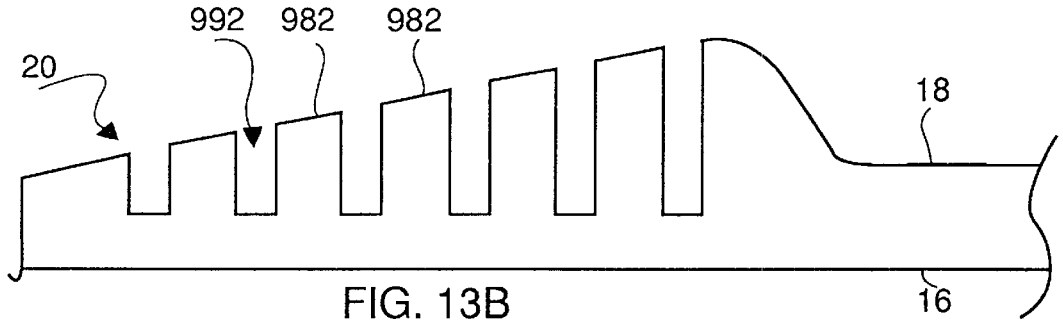
Figure 13C:
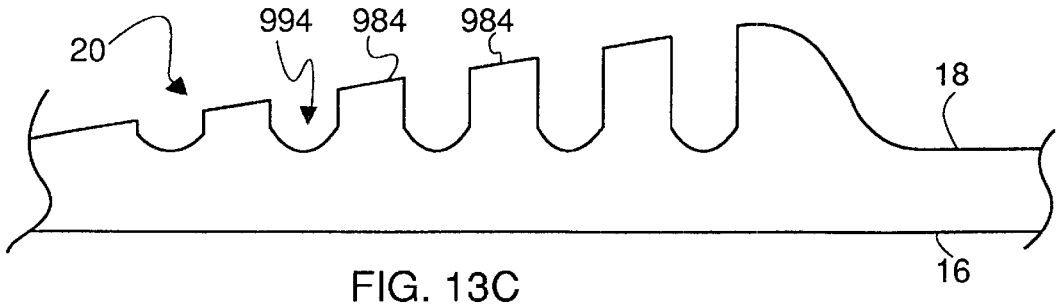

For instance, FIGS. 13A to 13C show three embodiments of a sportsboard 10 having added flexibility in accordance with an aspect of the present invention.

In particular, FIG. 13A shows a plurality of angled grooves 990 cut in linear paths widthwise across the upper surface 18 of a sportsboard 10. The angled grooves 990 result in a serrated portion of the upper surface. FIG. 13B shows the formation of grooves normal or orthogonal to the lower surface 16 of the sportsboard 10 in a widthwise direction across the upper surface 18 of the sportsboard 10. FIG. 13C shows the formation of U-shaped grooves 994 in the upper surface 18 of the sportsboard 10. In all cases, the grooves 990–994 increase the flexibility of the sportsboard 10 by decreasing the amount of compression forces necessary to bend or deflect the sportsboard 10.

While the grooves 990–994 shown in FIGS. 13A to 13C are shown normal to the lower surface 16 of the sportsboard 10, it will be understood by those of ordinary skill in the art that the grooves 990–994 may alternatively be formed or cut at any appropriate angle, e.g., normal to the upper surface 18 and/or normal to the lower surface 16, in accordance with the principles of the present invention.

In the case of a snowboard, because of the compression of the upper surface 18, the boot bindings should be mounted so as to allow sufficient lateral movement of the upper surface 18 of the sportsboard 10 in a widthwise direction to allow the maximum desired amount of compression of the upper surface 18 of the sportsboard 10. Alternatively, the flexibility can be added in portions of the sportsboard 10 other than directly under the location of contact with the extremity. For instance, the grooves 990–994 may be cut after appropriate bindings or other apparatus is mounted to the upper surface 18 of the sportsboard. In this way, the grooves 990–994 may be placed on either side of the binding and not under the binding.

The grooves 990–984, while being shown in FIG. 13A in a portion of the extremity contacting portion, may be located at any point along the length of the sportsboard 10 to provide added flexibility thereto.

Figure 14A:
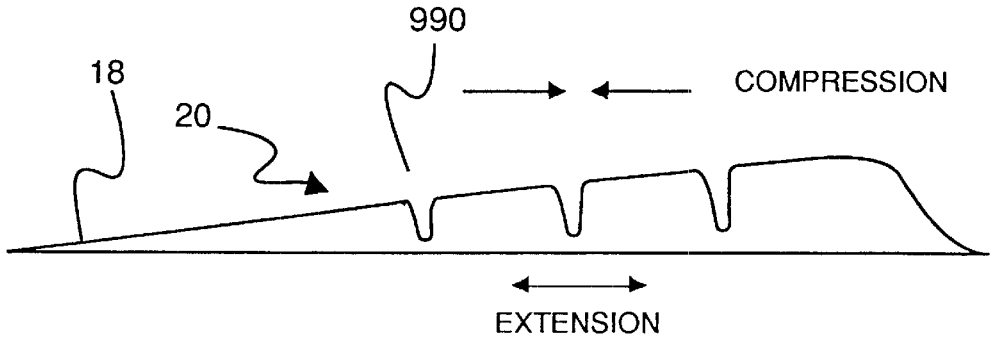
FIGS. 14A and 14B show the compression of the upper surface of a sportsboard having added flexibility in accordance with an aspect of the present invention.
Figure 14B:
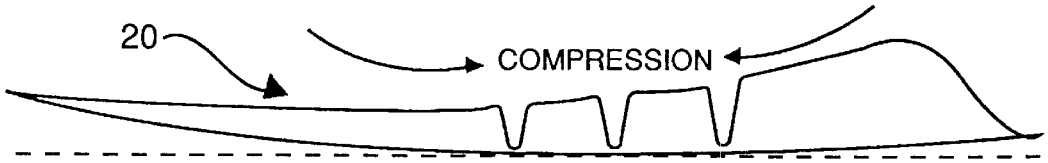

FIG. 14A depicts an ergonomic sportsboard having angled grooves 990 formed in an upper surface 18 thereof before flexion, and FIG. 14B shows the compression of the upper surface 18 of the ergonomic sportsboard shown in FIG. 14A when flexed.

The core components 36 (FIGS. 1 to 3) or 36' (FIGS. 8 to 10) may be inserted within the body of the sportsboard 10 by any one or more of a plurality of manufacturing processes. For example, the cores 36 or 36' may be formed integrally within the sportsboard 10 during an injection process.

Alternatively, the cores 36 or 36' may be inserted between the upper surface 16 and the lower surface 18 during a pressure mold manufacturing process. Other suitable manufacturing processes include plastic injection molding, foam molding, and/or a formed wood core.

Although the embodiments shown in FIGS. 1 to 3 and 8 to 10 include first and second end sections 12 and 14 that curve upwardly, it should be understood that the rider's feet are not generally rested or mounted on the upwardly curving first and second end sections 12 and 14 during riding, i.e., the first and second end sections 12 and 14 are not general riding surfaces. The present invention may be implemented in a sportsboard with or without upwardly curving first and second end sections 12 and 14 without departing from the scope of the invention.

FIGS. 15A to 17 show various embodiments of a snowboard having an ergonomic upper surface, e.g., an INTRACANT™ upper surface, in accordance with the principles of the present invention.

Figure 15A:
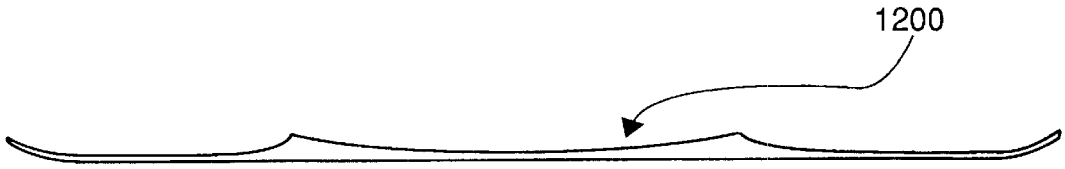
FIGS. 15A to 15C show three views of a snowboard having an ergonomic upper surface in accordance with the principles of the present invention.
Figure 15B:
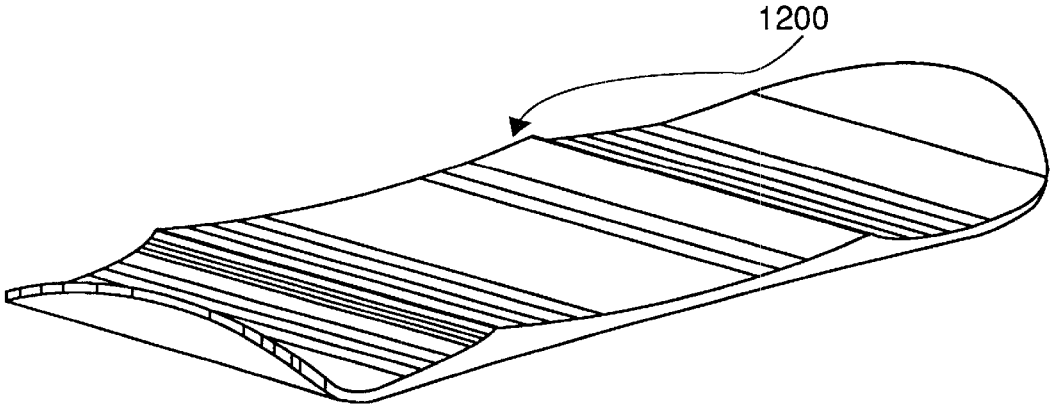
Figure 15C:
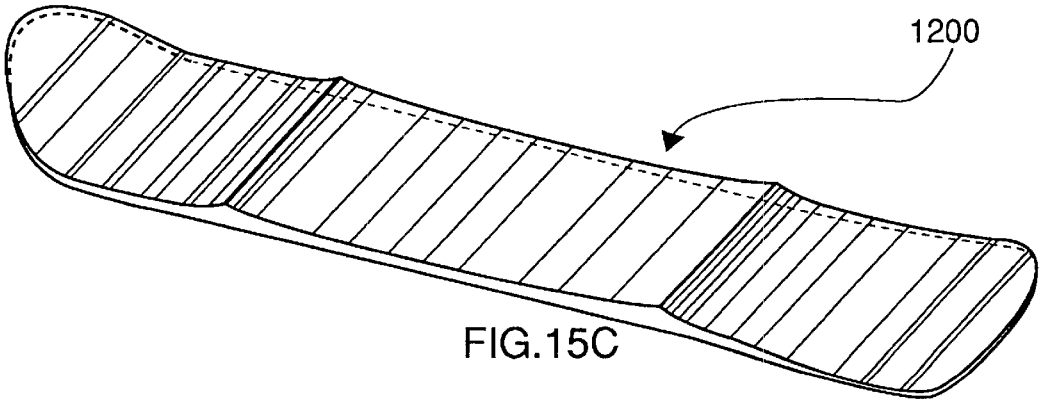
Figure 16:
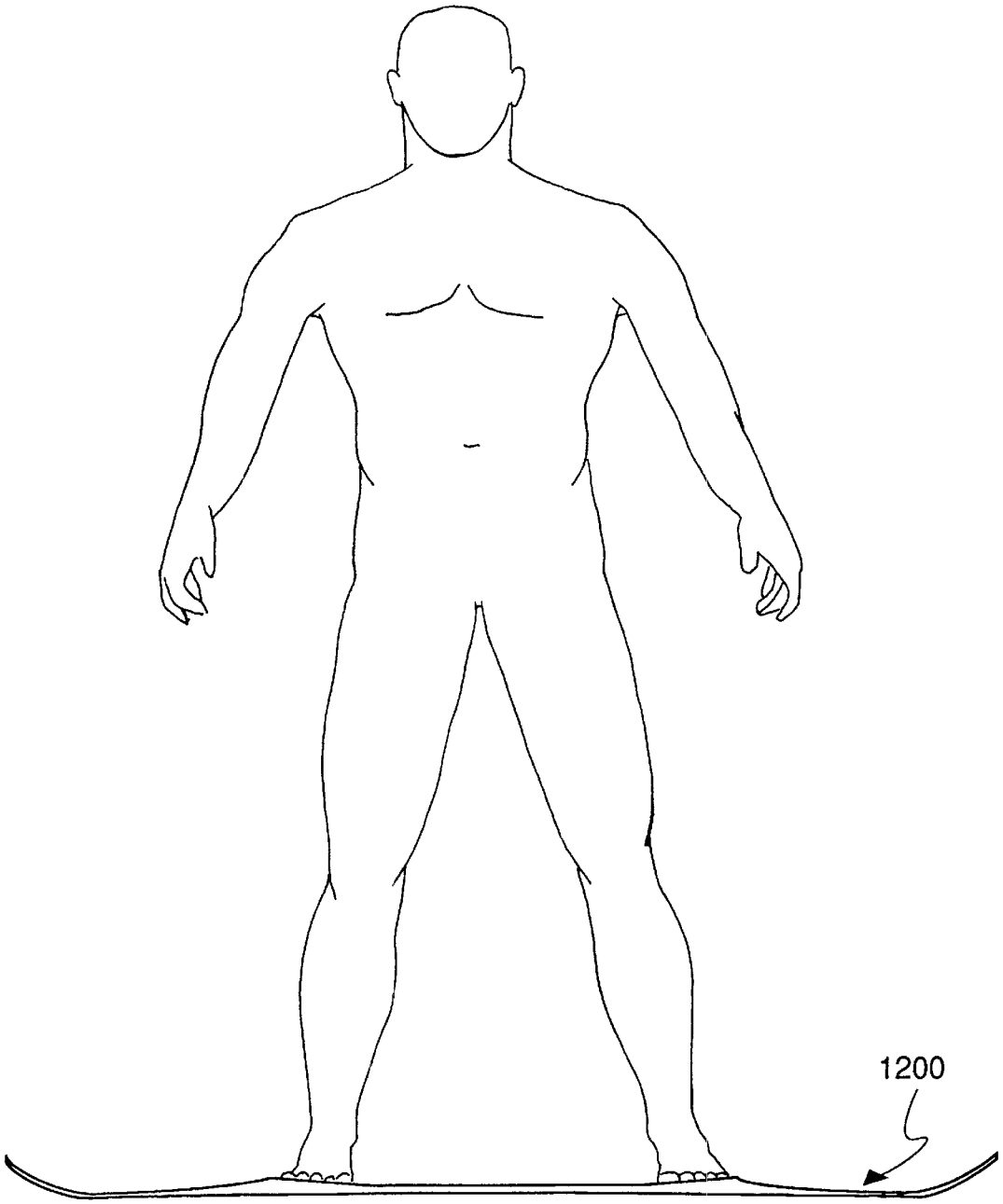
FIG. 16 depicts the posture of a human body in a typical position when riding a sportsboard having an ergonomic upper surface in accordance with the principles of the present invention.

In particular, FIGS. 15A to 15C show three views of a snowboard 1200 having an ergonomic upper surface in accordance with the principles of the present invention. FIG. 16 depicts the posture of a human body in a typical position when riding the snowboard 1200 shown in FIGS. 15A to 15C.

Figure 17:
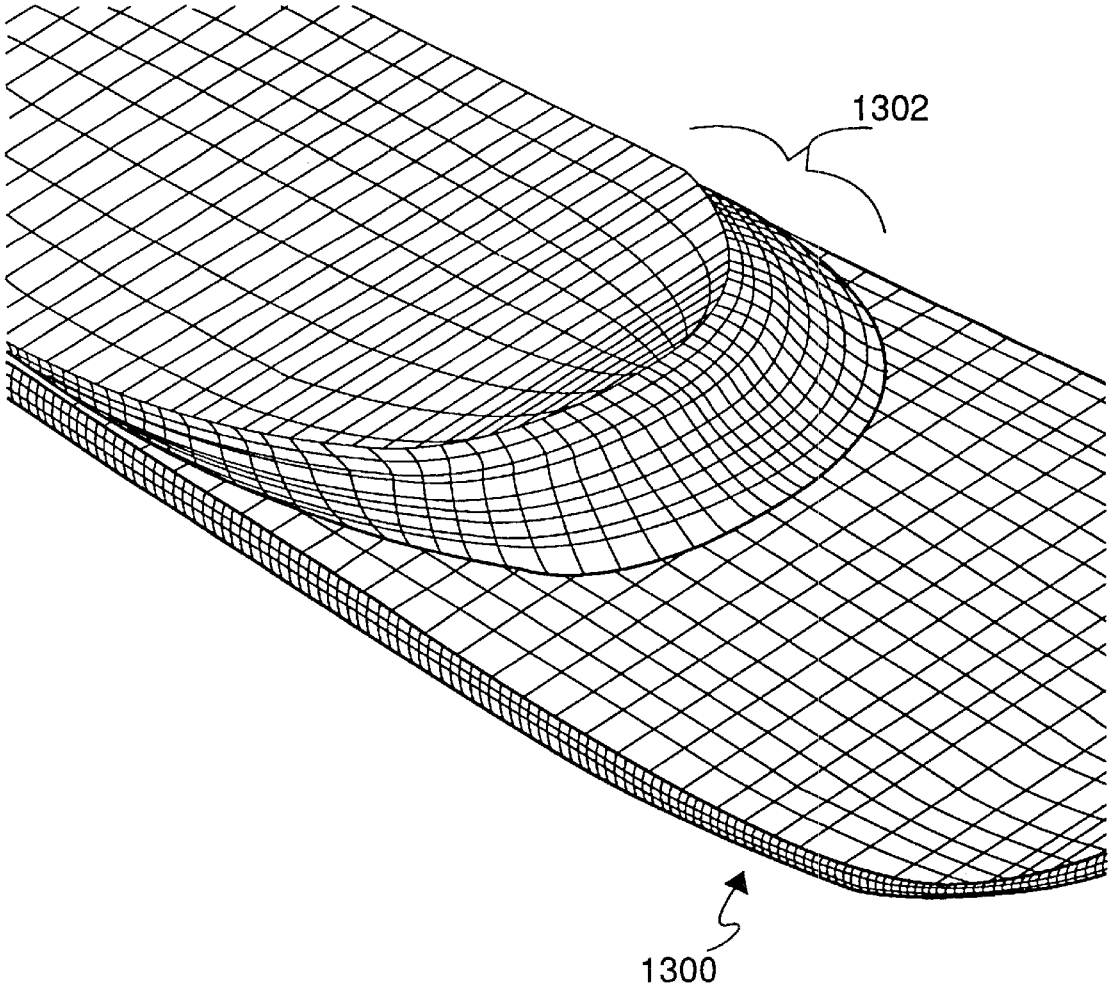
FIG. 17 shows one end of another embodiment of a snowboard having an ergonomic extremity contacting portion in accordance with the principles of the present invention.

FIG. 17 shows one end of another embodiment of a snowboard 1300 having an ergonomic extremity contacting portion 1302 in accordance with the principles of the present invention. Note that the extremity contacting portion 1302 is arcuate with respect to the upper surface of the snowboard 1300, to provide similar ergonomic benefits through a range of non-parallel angles of the extremity, e.g., a foot, with respect to the snowboard 1300.

Figure 18:
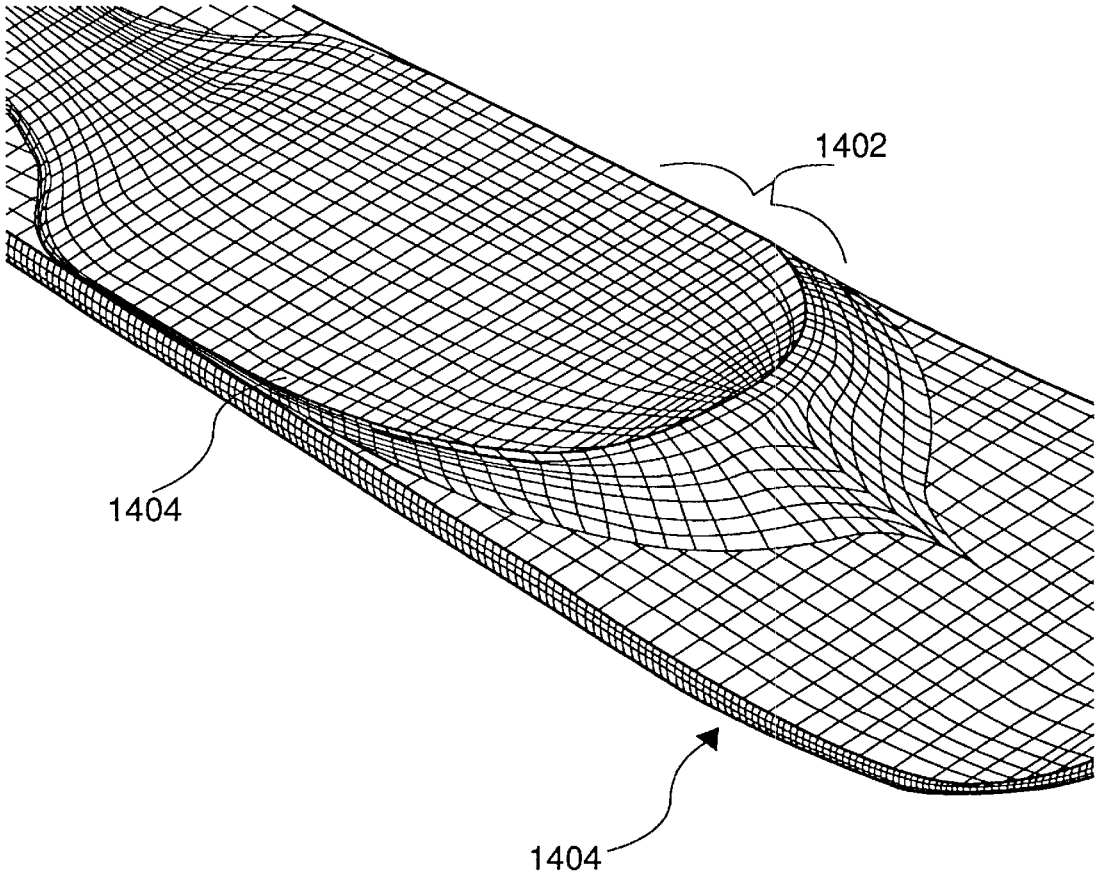
FIG. 18 shows one end of yet another embodiment of a snowboard having an ergonomic extremity contacting portion in accordance with the principles of the present invention.

FIG. 18 shows one end of yet another embodiment of a snowboard 1400 having an ergonomic extremity contacting portion 1402 in accordance with the principles of the present invention. The extremity contacting portion 1402 in this embodiment is pointed in the region 1404, recognizing that the extremity on a snowboard is not mounted parallel to the length of the snowboard 1400.

Figure 19:
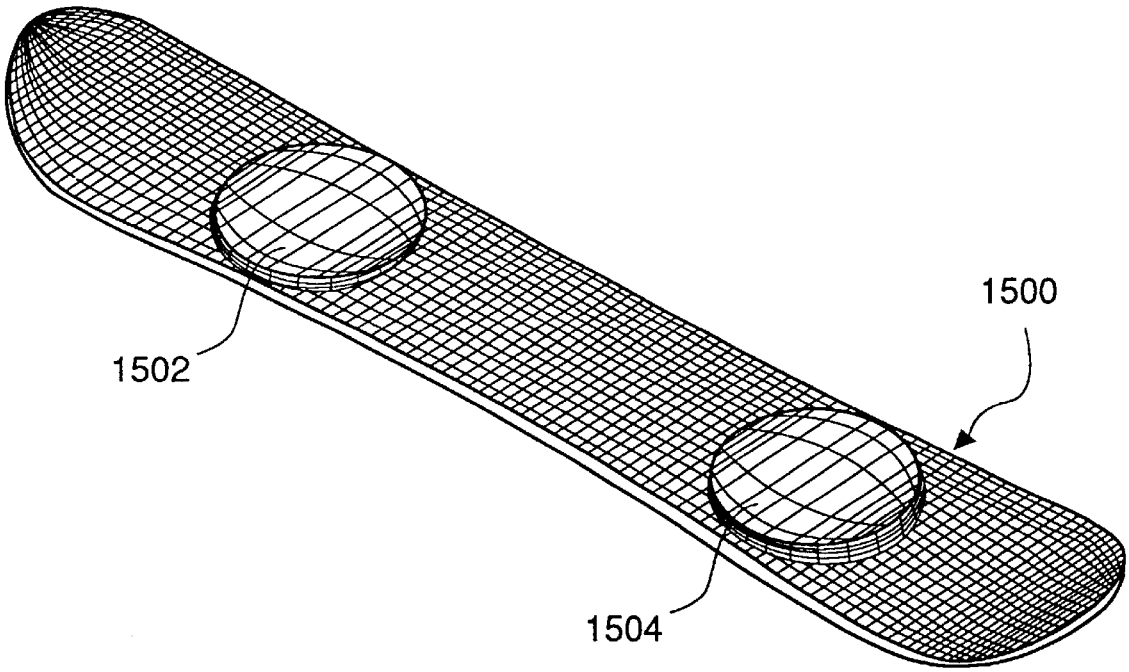
FIG. 19 shows another embodiment of a snowboard having an ergonomic upper surface in accordance with the principles of the present invention.

FIG. 19 shows another embodiment of a snowboard 1500 having integral ergonomic pads 1502, 1504 on the upper surface of the snowboard 1500, in accordance with the principles of the present invention.

The present invention provides a rider of a sportsboard with a healthier and more controlled stance without requiring added components between, e.g., a snowboard binding and the snowboard, thus saving weight and structural integrity of the overall sportsboard. The INTRACANT™ ergonomic upper surface in accordance with the principles of the present invention provides a rider increased comfort, endurance, stability, momentum at the contacting extremity, and more power. The INTRACANT™ ergonomic upper surface in accordance with the principles of the present invention reduces torsional stress, and provides a more rapid impulse transmission from 'brain to sportsboard'.

Moreover, the sportsboard, being slightly thicker around the point of contact with the rider's extremities, is stronger with respect to downward impact, distributes forces more evenly along the edge of the sportsboard, and significantly reduces asymmetric forces. This increases the reliability of, e.g., the lamination and shear strength of snowboard edges, which commonly delaminate and/or shear in thinner snowboards.

The unibody type construction of the upper surface and the ergonomic shape of the upper surface do not add significant weight to the sportsboard. Moreover, particularly in the case of snowboards or other sportsboards requiring a mounted binding, the thicker extremity contacting sections allow for higher inserts having more threads inserted into the sportsboard, increasing the strength of the bond between the bindings and sportsboard significantly.

The present invention is equally applicable to upper surface platforms which may be attached to substantially the entire upper surface of a sportsboard. For instance, a platform forming the upper surface 18 may be mated with a relatively flat upper surface of a conventional sportsboard to form a new upper surface 18 including the extremity contacting sections 20, 22. With a snowboard, an ergonomic upper surface 18 may be formed in a unibody-type construction and adhered to a conventional snowboard with, e.g., highly resistant two-sided foam urethane or neoprene tape. This semi-dense two-sided tape is known, and is typically about 1/64" thick. The platform would be further adhered to the conventional upper surface of the snowboard with the mounting screws which pass through the platform and mount into the core of the conventional snowboard.

While the present invention has been shown with respect to, and has particular application to, snowboarding, it is equally applicable to any sportsboard ridden in an upright standing position (e.g., surfboards, mono water skis, etc.) or upright kneeling position (e.g., a wakeboard, etc.).

While the invention has been described with reference to exemplary embodiments thereof, those skilled in the art will be able to make various modifications to the described embodiments of the invention without departing from the true spirit and scope of the invention.

What is claimed is:

1. A snowboard, comprising:

an upper surface adapted to contact at least one boot of a rider; and a lower surface adapted to contact snow to be ridden;

said snowboard including a core having an increasing thickness at a binding contacting section adapted to contact said at least one boot of said rider; and said snowboard having a decreased thickness outwardly beyond said increasing thickness at said binding contacting section.

2. The snowboard according to claim 1, wherein:

said increasing thickness forms an angle of said binding contacting section with respect to a lengthwise axis of said snowboard of between 1° and 20° at a point of contact with said boot.

3. The snowboard according to claim 2, wherein:

said angle is between 5° and 12°.

4. The snowboard according to claim 2, wherein:

said angle is at least 6°.

5. The snowboard according to claim 1, further comprising:

at least one widthwise groove in said upper surface, said at least one widthwise groove increasing flexibility in said snowboard.

6. A snowboard, comprising:

an upper surface adapted to contact at least one boot of a rider; and a lower surface adapted to contact snow to be ridden;

said snowboard including a plurality of grooves formed widthwise into a core of said snowboard, said plurality of grooves increasing lengthwise flexibility in said snowboard.

7. The snowboard according to claim 6, wherein:

said plurality of grooves are formed in an area of said snowboard having an increasing thickness with respect to a center of said snowboard.

* * * * *